US012655758B2

(12) United States Patent
Zhan et al.

(10) Patent No.: US 12,655,758 B2
(45) Date of Patent: Jun. 16, 2026

(54) MUD PULSER HAVING A FILTER HOUSING

(71) Applicant: CHINA PETROLEUM & CHEMICAL CORPORATION, Beijing (CN)

(72) Inventors: Sheng Zhan, Houston, TX (US); Derek M. Shumaker, Houston, TX (US); Sam Seldon, Houston, TX (US); Randall Istre, Houston, TX (US)

(73) Assignee: CHINA PETROLEUM & CHEMICAL CORPORATION, Beijing (CN)

( * ) Notice: Subject to any disclaimer, the term of this patent is extended or adjusted under 35 U.S.C. 154(b) by 0 days.

(21) Appl. No.: 18/928,009

(22) Filed: Oct. 26, 2024

(65) Prior Publication Data

US 2026/0117650 A1 Apr. 30, 2026

(51) Int. Cl.
*E21B 47/24* (2012.01)

(52) U.S. Cl.
CPC ..... *E21B 47/24* (2020.05); *E21B 2200/05* (2020.05)

(58) Field of Classification Search
CPC ..... E21B 2200/05; E21B 47/12; E21B 47/14; E21B 47/18; E21B 47/20; E21B 47/24
See application file for complete search history.

(56) References Cited

U.S. PATENT DOCUMENTS

| | | | | |
|---|---|---|---|---|
| 6,016,288 | A | 1/2000 | Frith | |
| 7,467,658 | B2 | 12/2008 | Kent et al. | |
| 8,689,884 | B2 | 4/2014 | Young et al. | |
| 9,638,025 | B2 | 5/2017 | Pare et al. | |
| 10,060,196 | B2 * | 8/2018 | Richards | E21B 47/135 |
| 11,359,486 | B2 * | 6/2022 | Zhan | E21B 17/22 |
| 11,982,181 | B2 * | 5/2024 | Weber | E21B 47/24 |
| 2010/0243401 | A1 | 9/2010 | Diosi et al. | |
| 2019/0301267 | A1 | 10/2019 | Segura | |

* cited by examiner

*Primary Examiner* — Franklin D Balseca
(74) *Attorney, Agent, or Firm* — NKL Law; Allen Xue

(57) ABSTRACT

A mud pulser includes a connector housing, a motor housing, a ball screw housing, a pressure compensation piston housing, and a filter housing that are tubular in shape and connected serially to form a tubular housing. A pressure compensation piston separates the tubular housing into a proximal portion and a distal portion; a motor resides in the proximal portion; a servo valve resides in the distal portion; a piston shaft is coupled to the motor and extends through the pressure compensation piston into the distal portion. The motor causes the poppet shaft to reciprocate along a longitudinal direction of the tubular housing. The filter housing contains a plurality of slots that extend into an inter cavity of the filter housing.

6 Claims, 3 Drawing Sheets

SECTION A-A

SECTION A-A CONTINUED

MUD PULSER HAVING A FILTER HOUSING

TECHNICAL FIELD

The present disclosure provides an oil drilling system including a drill string with a pulser that generates pulses representing information to be transmitted from the drill string to the surface.

BACKGROUND

Rotary drilling techniques is a common practice in the drilling of deep bore holes for the exploration and extraction of crude oil and natural gas. This technique involves using a drill string, which consists of numerous sections of hollow pipe connected together and to the bottom end of which a drilling bit is attached. By exerting axial forces onto the drilling bit face and by rotating the drill string from the surface, a reasonably smooth and tubular bore hole is created. The rotation and compression of the drilling bit causes the formation being drilled to be successively crushed and pulverized. Drilling fluid, frequently referred to as "drilling mud" or "mud," is pumped down the hollow center of the drill string, through nozzles on the drilling bit and then back to the surface around the annulus of the drill string. This fluid circulation is used to transport the cuttings from the bottom of the bore hole to the surface, where they are filtered out and the drilling fluid is re-circulated as desired. The flow of the drilling fluid, in addition to removing cuttings, provides other functions such as cooling and lubricating the drilling bit cutting surfaces as well as exerting a hydrostatic pressure against the bore hole walls to help contain any entrapped gases encountered during the drilling process.

To enable the drilling fluid to travel through the hollow center of the drill string and the restrictive nozzles in the drilling bit and to have sufficient momentum to carry cuttings back to the surface, the fluid circulation system includes a pump or multiple pumps capable of sustaining sufficiently high pressures and flow rates, piping, valves and swivel joints to connect the piping to the rotating drill string.

Since the advent of drilling bore holes, the need to measure certain parameters at the bottom of the bore hole and provide this information to the driller has been recognized. These parameters include but are not limited to the temperature and pressure at the bottom of a bore well, the inclination or angle of the bore well, the direction or azimuth of the bore well, and various geophysical parameters that are of interest and value during the drilling process. The challenge of measuring these parameters in the hostile environment at the bottom of the bore hole during the drilling process and somehow conveying this information to the surface in a timely fashion has led to the development of many devices and practices.

There are obvious advantages to being able to send data from the bottom of the well to the surface while drilling without a mechanical connection or specifically using wires. This has resulted in Measuring-While-Drilling (MWD) instruments, which are widely used in oil and gas drilling and formation evaluation. For example, these MWD instruments may be installed in a bottom whole assembly (BHA) of a drill string coupled to a derrick above the earth surface. The MWD instruments may be part of an MWD system (MWD assembly) in the BHA of the drill string.

Communicating information including measurement data from the MWD instruments in the ground to a computing device on the surface may be accomplished using a pulser, which generates and transmits pressure pulses through a column of drilling fluid in the drill string to one or more sensors connected to a pressure sensitive transducer and further to a computing device located on the surface. The pressure pulses represent data and are generated by using a valve mechanism in the pulser. However, there are drawbacks with existing pulser technologies, including clogging, lack of proper lubrication, as well as weak pressure pulses, e.g., in deep wells.

Accordingly, there is a need for a new pulser for efficiently and reliably generating and transmitting pressure pluses through the drilling fluid to a pressure sensor located on the surface.

SUMMARY

This disclosure provides devices, apparatuses, and methods for generating pressure pulses that propagate through a column of drilling mud in the drilling stream back to surface during drilling. Used herein, the pulser may be referred to as a "pressure pulse generator," "pulser mechanical module," or "pulser device."

In one of the embodiment of this disclosure, a pulser includes a connector housing, a motor housing, a ball screw housing, a pressure compensation piston housing, and a filter housing that are tubular in shape and connected serially to form a tubular housing. A pressure compensation piston separating the tubular housing into a proximal portion and a distal portion; a motor resides in the proximal portion; a servo valve resides in the distal portion; a piston shaft is coupled to the motor and extends through the pressure compensation piston into the distal portion. The motor causes the piston shaft to reciprocate along a longitudinal direction of the tubular housing.

The filter housing contains a plurality of slots that extend into an inter cavity of the filter housing. The servo valve comprises a poppet detachably affixed to the poppet shaft and an orifice member having an orifice that allows the drilling fluid to pass through. Reciprocating motions of the poppet shaft cause the poppet to close or open the orifice, thereby stopping or releasing a flow of the drilling fluid through the pulser.

In an aspect of the embodiment, the filter housing is tubular in shape and has a proximate member and a distal member disposed on each side of the inter cavity. The proximate member has a through-hole in the center, and a plurality of grooves extending radially toward an outer surface of the filter housing, each groove is connected to one of the plurality of the slots.

In another aspect of the embodiment, the electric motor causes the poppet shaft to reciprocate along a longitudinal direction of the tubular housing. The servo valve has a poppet detachably affixed to the poppet shaft and an orifice member having an orifice that allows the drilling fluid to pass, wherein a reciprocating motion of the poppet shaft causes the poppet to close or open the orifice, thereby stopping or releasing a flow of the drilling fluid through the pulser.

In a further aspect, the orifice in the orifice member has a diameter ranging from 0.2" to 0.5", and the poppet has a size that matches the orifice.

In still another aspect of the embodiment, the orifice housing is detachably affixed to the tubular housing and detaching the orifice housing from the tubular housing exposes the poppet so that the poppet is accessible and can be removed from the tubular housing.

The pulser may still include a compression spring disposed in the distal portion of the tubular housing and exerts a force against the pressure compensation piston. During operation, the proximal portion is filled with a lubricant and the distal portion is filled with the drilling fluid, wherein the pressure compensation piston moves along the longitudinal direction of the tubular housing in response to a pressure difference between the lubricant and the drilling fluid.

In another embodiment of the pulser, the pressure compensation piston includes a spiral pattern on an outer surface of the pressure compensation piston and the inner surface of the pressure compensation piston. The spiral pattern may include a plurality of spiral grooves of a rectangular shape. During operation, the lubricant fills the spiral grooves. In a further aspect, each of the spiral grooves is about 1/16 inches wide and about 1/32 inches deep, and wraps around the inner diameter and the outer diameter at approximately one revolution for every two inches of a length of the pressure compensation piston.

In still another embodiment, the pulser may contain a pressure balance plate disposed between the pressure compensation piston and the compression spring.

Further, the pulser may have a first sealing ring that seals a gap between the pressure compensation piston and the tubular housing and a second sealing ring that seals a gap between the pressure compensation piston and the piston shaft.

This disclosure provides a method to operate the pulser. The method includes steps of estimating the depth of the pulser in a bore hole; estimating an amplitude of pressure pulses required for the pressure pulses to propagate from the estimated depth to the surface; selecting a diameter of the orifice and the poppet required for generating pressure pulses of the estimated amplitude; installing the orifice member having the selected orifice of and the poppet in the pulser. For example, when the estimated amplitude of the pressure pulses is about 500 psi, the selected orifice may have a diameter of 0.5 inches.

In one aspect of the embodiment, the method also includes the step of replacing an orifice member in the pulser; affixing the poppet to the poppet shaft.

Further, the orifice member is selected from a plurality of orifice members having a common outer diameter, and each of the plurality of orifice members has an orifice of different diameter.

BRIEF DESCRIPTION OF THE DRAWINGS

The teachings of the present invention can be readily understood by considering the following detailed description in conjunction with the accompanying drawings.

Figure 1:
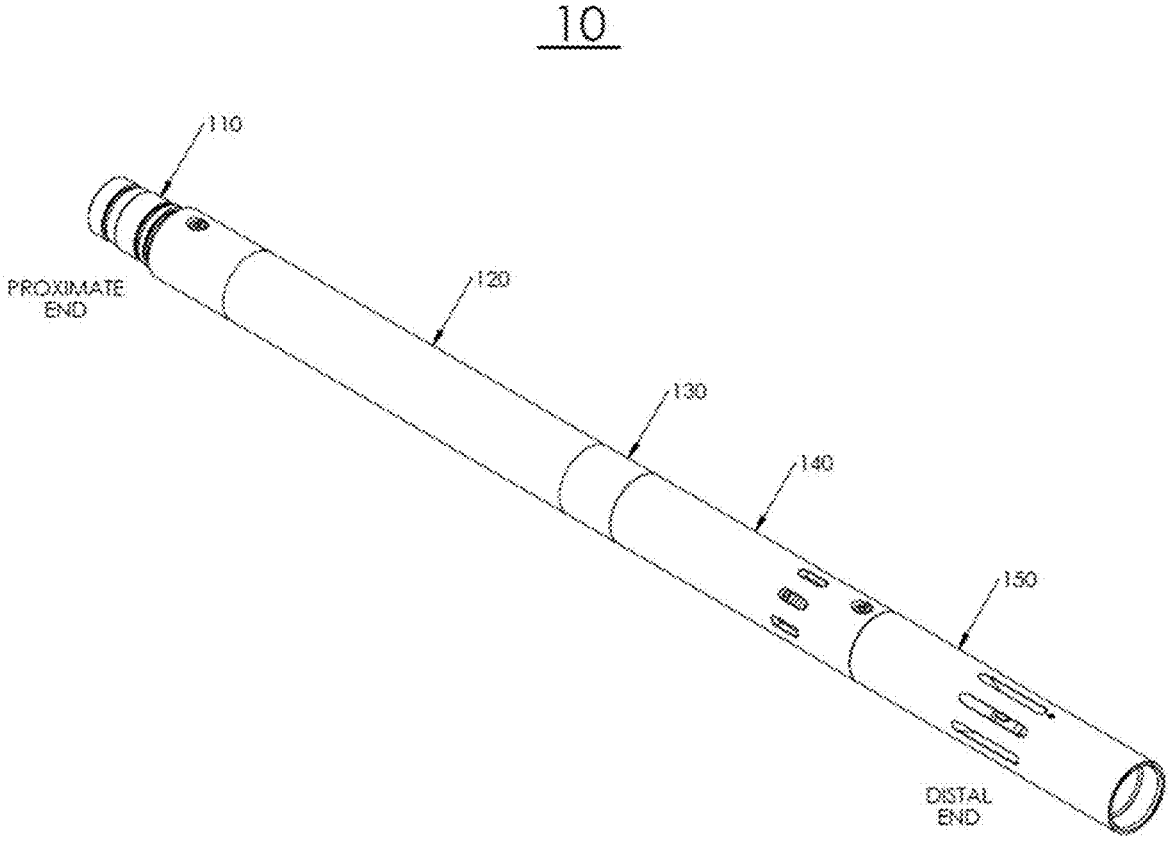
FIG. 1 is a plan view of a pulser according to an embodiment.

10—pulser, 110—connector housing, 114—female rotatable connector, 115—male rotatable connector, 120—motor housing, 121—motor, 130—ball screw housing, 131—ball screw, 140—pressure compensation piston housing, 141—poppet shaft, 142—pressure compensation piston, 143—compression spring, 144—poppet, 145—piston shaft, 150—filter housing, 151—slot, 152—proximate member, 153—distal member, 154—orifice member, 155—groove, 156—through-hole, and 157—set screw.

DETAILED DESCRIPTION

Reference will now be made in detail to embodiments of the present disclosure, examples of which are illustrated in the accompanying drawings. It is noted that wherever practicable, similar or like reference numbers may be used in the drawings and may indicate similar or like elements.

The drawings depict embodiments of the present disclosure for purposes of illustration only. One skilled in the art would readily recognize from the following description that alternative embodiments exist without departing from the general principles of the disclosure.

In one or more exemplary embodiments, information of use to the driller may be measured at the bottom of a bore hole relatively close to the drilling bit and this information is transmitted to the surface using pressure pulses in a drilling fluid circulation loop. The command to initiate the transmission of data may be sent by stopping drilling fluid circulation and allowing the drill string to remain still for a minimum period of time. Upon detection of this command, a measuring-while-drilling (MWD) system (MWD assembly or MWD tool) may measure at least one downhole condition, usually an analog signal, and this signal may be processed by the MWD tool and readied for transmission to the surface. When the drilling fluid circulation is restarted, the MWD tool may wait a predetermined amount of time to allow the drilling fluid flow to stabilize and then begin transmission of the information by repeatedly closing and then opening a pulser valve to generate pressure pulses in the drilling fluid circulation loop. The sequence of pulses sent is encoded into a format that allows the information to be decoded at the surface and the embedded information extracted and displayed on a display screen.

More specifically, a novel pulser ("pressure pulse generator", "pulser mechanical module", or "pulser device") may be coupled to a sensor package, a controller and a battery power source all of which reside inside a short section of drill string close to the bit at the bottom of the bore hole being drilled. The MWD system can be commanded from the surface to measure desired parameters and to transmit measurement data to the surface. Upon receiving the command to transmit information, a downhole controller gathers pertinent data from the sensor package and transmits this information to the surface by encoding data in pressure pulses. These pressure pulses travel up the drilling fluid column inside the drill string and are detected at the surface by a pressure sensitive transducer coupled to a computer which decodes and displays the transmitted data on a display screen.

The measuring-while-drilling (MWD) systems may for example contain a survey tool that measures formation properties (e.g. resistivity, natural gamma ray, porosity), wellbore geometry (inclination, azimuth), drilling system orientation (tool face), and mechanical properties of the drilling process for drilling a well. MWD instruments or systems measure wellbore trajectory, provide magnetic or gravity tool faces for directional control and a telemetry system that pulses data up through the drill string as pressure waves (i.e., generating pressure pulses which propagate through a mud column).

A modern oil drilling system may be used for drilling on land as well as beneath the water. It may be a rotary drilling rig that includes a derrick, drill floor, draw works, traveling block, hook, swivel joint, kelly joint and rotary table. A drill string used to drill the bore well includes a plurality of drill pipes that are serially connected and secured to the bottom of the kelly joint at the surface.

The rotary table is used to rotate the entire drill string while the draw works is used to lower the drill string into the bore hole and apply controlled axial compressive loads. The lower part of the drill string is a bottom hole assembly ("BHA").

The drilling fluid (also referred to as mud) is usually stored in mud pits or mud tanks, and is transferred using a mud pump, which forces the drilling fluid to flow through a surge suppressor, then through a kelly hose, and through the swivel joint and into the top of the drill string. The drilling fluid flows through the drill string at about 150 gallons per minute to about 600 gallons per minute and flows into the bottom hole assembly. The drilling fluid then returns to the surface by traveling through the annular space between the outer surface of the drill string and the bore hole.

When the drilling fluid reaches the surface, it is diverted through a mud return line back to the mud tank.

The pressure required to keep the drilling fluid in circulation is measured by a pressure sensitive transducer on the kelly hose. The pressure sensitive transducer detects changes in pressure caused by the pressure pulses generated by a pulser. The magnitude of the pressure wave from the pulser may be up to 500 psi or more. The measured pressure is transmitted as electrical signals through transducer cable to a surface computer, which decodes and displays the transmitted information. Alternatively, the measured pressure is transmitted as electrical signals through transducer cable to a decoder which decodes the electrical signals and transmits the decoded signals to a surface computer which displays the data on a display screen.

As indicated above, the lower part ("distal part") of the drill string includes the bottom hole assembly, which includes a non-magnetic drill collar with a MWD system (MWD assembly or MWD tool) installed therein, logging-while drilling (LWD) instruments, a downhole motor, a near-bit measurement sub, and the drill bit having drilling nozzles. The drilling fluid flows through the drill string and is output through the drilling nozzles of the drill bit. During the drilling operation, the drilling system may operate in rotary mode, in which the drill string is rotated from the surface either by the rotary table or a motor in the traveling block (i.e., a top drive). The drilling system may also operate in a sliding mode, in which the drill string is not rotated from the surface but is driven by the downhole motor rotating the drill bit. The drilling fluid is pumped from the surface through the drill string to the drill bit, being injected into an annulus between the drill string and the wall of the bore hole. As discussed above, the drilling fluid carries the cuttings up from the bore hole to the surface. Bore hole may also be referred to as a well or drilling well.

In one or more embodiments, the MWD system may include a pulser sub, a pulser driver sub, a battery sub, a central storage unit, a master board, a power supply sub, a directional module sub, and other sensor boards. In some embodiments, some of these devices may be located in other areas of the BHA. One or more of the pulser sub and pulser driver sub may communicate with the pulser, which may be located below the MWD system. The MWD system can transmit data to the pulser so that the pulser generates pressure pulses.

The non-magnetic drill collar houses the MWD system, which includes a package of instruments for measuring inclination, azimuth, well trajectory (bore hole trajectory), etc. Also included in the non-magnetic drill collar or other locations in the drill string are LWD instruments such as a neutron-porosity measurement tool and a density measurement tool, which are used to determine formation properties such as porosity and density. The instruments may be electrically or wirelessly coupled together, powered by a battery pack or a power generator driven by the drilling fluid. All information gathered may be transmitted to the surface via in the form of pressure pulses through the mud column in the drill string.

The near-bit measurement sub may be disposed between the downhole motor and drill bit, measuring formation resistivity, gamma ray, and the well trajectory. The data may be transmitted through the cable embedded in the downhole motor to the MWD system in the bottom whole assembly. A pulser may be positioned below the MWD system to communicate with the MWD system.

FIG. 1 is a perspective view of an exemplary pulser 10 according to an embodiment. The pulser 10 is tubular in shape. It has a connector housing 110 at the proximate end, followed by a motor housing 120, a ball screw housing 130, a pressure compensation piston housing 140, and a filter housing 150 at the distal end of the pulser. The housings are connected together to form an integral part, which is installed in the drill string.

Figure 2:
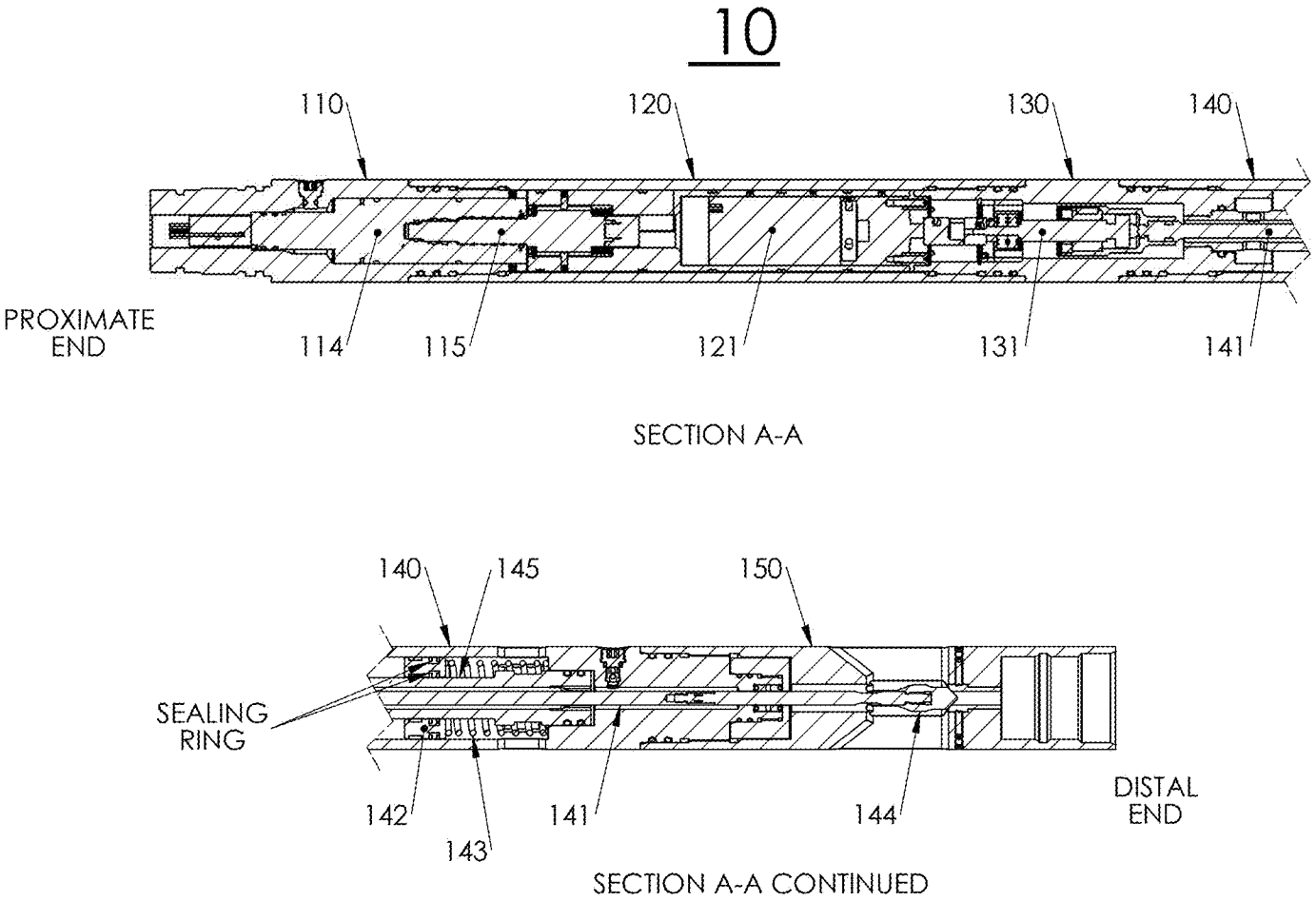
FIG. 2 is a section view of a pulser according to an embodiment.

FIG. 2 is a section view showing the interior of the pulser 10, which includes the connector housing 110, the motor housing 120, the ball screw housing 130, the pressure compensation piston housing 140, and the filter housing 150 connected in series.

The connector housing 110 receives a rotatable connector assembly that includes a female rotatable connector 114 and a male rotatable connector 115 inserted into the female rotatable connector 114. The proximate end of the female rotatable connector 104 has a bundle of wire connected thereto, e.g., through a solder cup (not shown).

The examplary male rotatable connector 115 has four cylinders of various diameters sequentially and concentrically connected. The number of cylinders may be more or less according to the needs and operability, e.g., 2-6. The outer surfaces of the concentric cylinders form corresponding number of steps. Each step has one or more electrical contacts disposed thereon. In some embodiments, the conductor band disposed on the first step is for electrical grounding; conductor bands disposed on the second step are for Hall effect sensor power for powering a Hall sensor switch of a DC brushless motor (not shown) electrically and signally connected to the interconnector; conductor bands disposed on the third step are for supplying power to the DC brushless motor (not shown); and conductor bands disposed on the fourth step are for passing signals to the Hall effect sensor (not shown). In other embodiments, all conductor bands have the same voltage and current rating so that each of them can carry power or data signals. In still other embodiments, the conductor bands may have different ratings so that some of them are designed to carry power while others are configured to carry data signals.

Conversely, the distal portion of the female rotatable connector 114 forms a cavity having four steps corresponding to the four steps in the male rotatable connector 105. Each of the four steps in the female rotatable connector 114 also have contacts configured to form electrical connections with the conductor bands on the male rotatable connector 115 after assembly. The rotatable connect assembly maintains electrical connection during rotations.

Figure 3A:
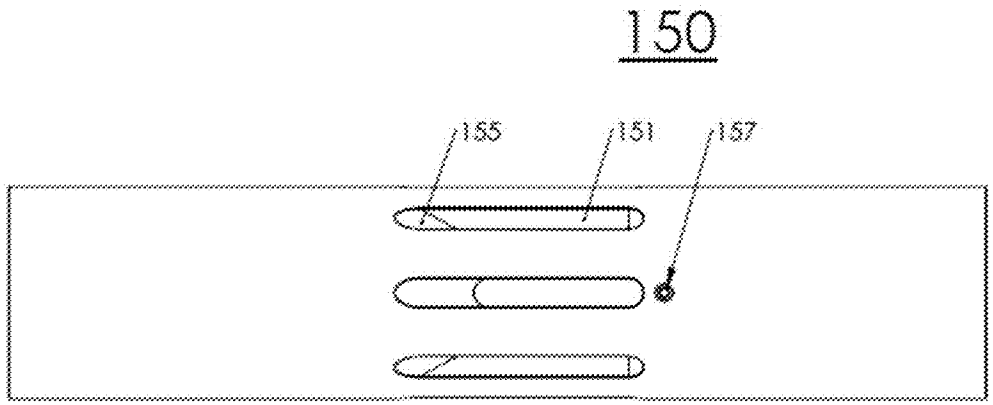
FIG. 3A is a plan view of the filter housing.
Figure 3B:
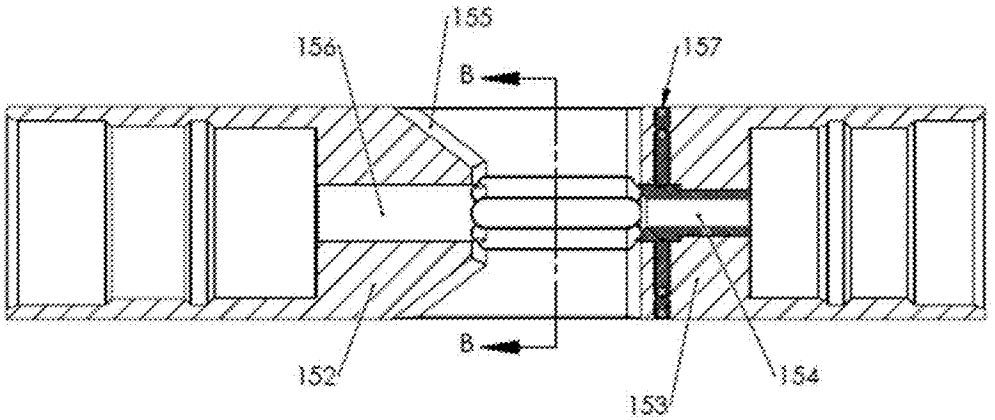
FIG. 3B is a section view of the filter housing along its axial direction.

Referring to FIGS. 3A and 3B, the filter housing 150 is tubular in shape. It has a plurality of slots disposed at a circumference of the filter housing 150. The proximate end of the filter housing 150 a female connector that can receive a male connector from the pressure compensation spring housing 140, while the distal end is to receive a lower end assembly (not shown). The lower end assembly is commercially available, for example, from Enteq Drilling SHO in Houston, TX.

The middle section of the filter housing 150 contains a proximate member 152 where the poppet shaft 141 extends through and a distal member 153 having an orifice member 154 that can receive the poppet 144 and serves as a valve seat. In the embodiment shown in FIG. 3B, the orifice member 154 is tubular in shape and is seated in the distal member 153. The orifice member 154 is affixed in place by a pair of set screw 157. The opening of the orifice member 154, i.e., the orifice, serves as a seat that receives the poppet 144. As such, the orifice member 154 can be easily installed and/or replaced.

Figure 3C:
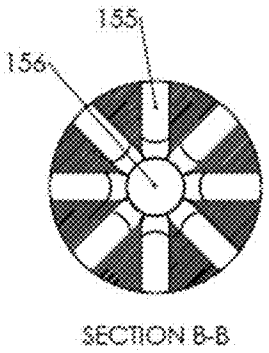
FIG. 3C shows the B-B cross section toward the proximate end of the filter housing.

As shown in FIGS. 3A, 3B, and 3C, the distal member 152 has a plurality of grooves 155. Each groove has one end connected to one end of the slot 151. The distal member 152 also has a through-hole that receives the poppet shaft 141. A proximate section of each slot 151 is cut at about 30°-50° angle from the outer surface inward along the direction of mud flow, e.g., toward the distal end.

During operation, the mud flow fills the cavity between the proximate member 152 and the distal member 153. The plurality of slots 151 prevent particulate matters from entering the cavity and blocking the orifice member 154. At the same time, the poppet 144, driven by the motor 121, moves back and forth along the longitudinal direction of the poppet shaft 141, thereby opening or closing the orifice member 154 and creating mud pulses that are released to the mud column via the lower end assembly into the mud column. The pressure pulses propagate in the mud column to the pressure sensitive transducer at the surface. The motor 121 may receive instructions from a downhole controller, which may be located in the MWD system.

Referring again to FIG. 3A, each slot 151 may be 2-4 inches in length, e.g., about 3 inches, and ⅛-½ inches in width, e.g., ¼ inch. The number of the slots is in the range of 4-12, e.g., 8 slots.

Referring back to FIG. 2, the motor 121 is connected to the ball screw 131 that converts rotations or oscillations of the motor 121 to linear movements. The ball screw 131 in turn is connected to the poppet shaft 141, thereby driving the poppet shaft 141 to reciprocate linearly. The pressure compensation piston housing 140 has a piston 142 and a compression spring 143, with the poppet shaft 141 extending through the pressure compensation piston housing 140.

The pressure compensation piston 140 is cylindrical in shape. It has a center through hole in its longitudinal direction to accommodate the poppet shaft 141. The pressure compensation piston 142 forms a seal against the inner wall of the housing 140, whereby separating the pulser 10 into a proximal portion (the portion closer to the ground surface) and a distal portion (the portion close to the bottom of the bore hole). The poppet 144 prevents the drilling fluid in the distal portion and the lubricant oil in the proximal portion from leaking into each other.

The piston 142 and the compression spring 143 work together to balance the pressure between the lubricant oil in the proximal portion and the drilling fluid in the distal portion of the pulser. During operation, the compression spring 143 is in a compressed state and the lubricant oil in the proximal portion and the drilling fluid in the distal portion are pressure-balanced. When the orifice member 154 is closed by the poppet 144 so that the pressure of the drilling fluid increases, the drilling fluid exerts a higher pressure on the piston 142 to the proximal direction, thereby increasing the pressure of the lubricant oil in the proximal portion. When the orifice member 154 opens, the pressure of the drilling fluid reduces, the piston 142 moves in the distal direction so as to reduce the pressure of the lubricant oil. Accordingly, the reciprocating movement of the piston 142 balances the pressure between the lubricant in the proximal portion and the drilling fluid in the distal portion.

The pressure of the drilling fluid can be up to 30,000 psi in a drilling operation while the magnitude of the pressure pulse can be up to 500 psi, which may require high pressure and high temperature metal seals. However, since the lubricant oil is almost an incompressible fluid, a slight change in its volume generates a large counter pressure, which balances out the pressure from the drilling fluid. Thus, this configuration makes it unnecessary to use an expensive high pressure, high temperature reciprocating seal.

Referring again to FIG. 3B, the filter housing 150 can be disconnected from the rest of the pulser 10, which allows the changing of orifice member 154 based on drilling conditions. For example, the orifice in the orifice member 154 has a diameter of 0.2 inches to 0.5 inches. Deeper wells may require stronger mud pulses and therefore larger orifices. In such a case, the filter housing 150 having a larger orifice is installed. The poppet 144 having a right size to match the orifice is installed on the tip of the poppet shaft 141.

FIG. 3C shows the face of the proximate member 152, which has six grooves 155 extending from the through-hole 156 radially toward the outer wall of the filter housing.

While embodiments of this disclosure have been shown and described, modifications can be made by one skilled in the art without departing from the spirit or teaching of this invention. The embodiments described herein are exemplary only and are not limiting. Many variations and modifications of methods, systems and apparatuses are possible and are within the scope of the invention. Accordingly, the scope of protection is not limited to the embodiments described herein. The scope of protection is only limited by the claims. The scope of the claims shall include all equivalents of the subject matter of the claims.

What is claimed is:

1. A pulser for generating pressure pulses in a drilling fluid during a drilling operation, comprising:

a connector housing, a motor housing, a ball screw housing, a pressure compensation piston housing, and a filter housing that are tubular in shape and connected serially to form a tubular housing;

a pressure compensation piston separating the tubular housing into a proximal portion and a distal portion;

a motor residing in the proximal portion;

a servo valve residing in the distal portion; and a poppet shaft coupled to the motor and extending through the pressure compensation piston into the distal portion, wherein the motor causes the poppet shaft to reciprocate along a longitudinal direction of the tubular housing, wherein the connector housing contains a rotatable connector assembly having a female rotatable connector and a male rotatable connector inserted into the female rotatable connector, wherein the filter housing is tubular in shape and comprises a plurality of straight slots, each straight slot has an elongated opening on a circumference of the filter housing having a length direction thereof arranged in parallel with a longitudinal direction of the tubular housing and extend into an inter cavity of the filter housing, wherein the filter housing further comprises a proximate member and a distal member disposed on each side of the inter cavity, the proximate member has a through-hole in the center thereof and a plurality of grooves extending radially from an opening of the through-hole toward an outer surface of the filter housing, each groove is connected to one of the plurality of straight slots, wherein the servo valve comprises a poppet detachably affixed to the poppet shaft and an orifice member having an orifice that allows the drilling fluid to pass, the orifice member is detachably disposed inside the distal member of the filter housing, and wherein a reciprocating motion of the poppet shaft causes the poppet to close or open the orifice, thereby stopping or releasing a flow of the drilling fluid through the pulser.

2. The pulser of claim 1, wherein the orifice in the orifice member has a diameter ranging from 0.2 inches to 0.5 inches, and the poppet has a size that matches the orifice.

3. The pulser of claim 1, further comprising a compression spring disposed in the distal portion of the tubular housing and exerts a force against the pressure compensation piston, wherein, during operation, the proximal portion is filled with a lubricant and the distal portion is filled with the drilling fluid, wherein the pressure compensation piston moves along the longitudinal direction of the tubular housing in response to a pressure difference between the lubricant and the drilling fluid.

4. The pulser of claim 1, further comprises a first sealing ring that seals a gap between the pressure compensation piston and the tubular housing and a second sealing ring that seals a gap between the pressure compensation piston and the poppet shaft.

5. The pulser of claim 4, wherein the first sealing ring is disposed about an outer surface of the pressure compensation piston and the second sealing ring is disposed about an inner surface of the pressure compensation piston.

6. The pulser of claim 1, wherein each groove is a straight groove extending from a circumference of the filter housing to the through-hole thereof in the direction from the proximate member toward the distal member and forms an inclined angle of 30°-50° with an axial direction of the filter housing.

* * * * *